United States Patent [19]

Meier, Jr.

[11] 3,948,135

[45] Apr. 6, 1976

[54] MACHINE TOOL

[75] Inventor: Henry A. Meier, Jr., Buffalo, N.Y.

[73] Assignee: Buffalo Forge Company, Buffalo, N.Y.

[22] Filed: Sept. 12, 1973

[21] Appl. No.: 396,398

[52] U.S. Cl. ..... 83/572; 83/530; 234/116; 83/590

[51] Int. Cl.[2] ..... B26D 5/10

[58] Field of Search ..... 83/571, 572, 590, 524, 83/530; 234/116

[56] References Cited

UNITED STATES PATENTS

| | | | |
|---|---|---|---|
| 650,692 | 5/1900 | Schärfl | 83/572 |
| 1,856,175 | 5/1932 | Towle | 83/572 |
| 2,062,692 | 12/1936 | Yates | 83/572 X |
| 2,640,541 | 6/1953 | Yates | 83/572 |

*Primary Examiner*—Donald R. Schran
*Attorney, Agent, or Firm*—Joseph P. Gastel

[57] ABSTRACT

A machine tool comprising a frame, a plunger mounted on the frame for carrying a work engaging tool, a way in said plunger for receiving a reciprocating ram, a punch block, a linkage for selectively inserting said punch block between the ram and the plunger so as to cause the ram to drive said plunger toward a work support, a bolt mechanism carried by said ram for selective operative engagement with said plunger to pull said plunger away from said work support only after said plunger has been driven toward said work support by said ram, camming surfaces on said plunger and said bolt for selectively disengaging said bolt from said plunger upon subsequent movement of said ram toward the work support, and a single stroke mechanism in said linkage to automatically withdraw said punch block after the driving of the plunger toward the work support whereby subsequent continued reciprocation of said ram will not drive said plunger unless said linkage is again actuated.

21 Claims, 11 Drawing Figures

MACHINE TOOL

The present invention relates to a machine tool of the type which is used to effect cutting or punching of a workpiece.

By way of background, there are in existence machine tools of the type shown in U.S. Pat. No. 2,062,692 in which a die or cutting member is mounted on a plunger which is selectively driven from a continuously reciprocating ram upon the actuation of a suitable linkage, to cause the tool to be driven into engagement with a workpiece and thereafter the ram, which is then secured to the plunger, moves the plunger so as to pull the tool away from the workpiece.

In the past the linkage associated with the ram and the plunger was of such a construction that upon actuation of the machine tool to effect a cutting or punching operation, the plunger carrying the tool could move away from the workpiece before it was driven toward the workpiece. This action, which was termed "raising of a spotted punch" action, was disconserting to the machine operator. In addition, prior linkages for coupling the ram and plunger had relatively high clearances which permitted the plunger to accelerate after the punch carried thereby broke through a workpiece, and this resulted in subjecting the machine to relatively high shock forces. In addition, prior constructions for moving the plunger away from the workpiece were relatively complicated. Furthermore, in the past single stroke mechanisms were utilized in machines of the foregoing type. These mechanisms served the function of permitting the machine to go through only a single cycle of operation when it was actuated. However, the mechanisms which were used in the past were relatively complicated. It is with overcoming the foregoing deficiencies of prior machine tools that the present invention is concerned.

It is accordingly one object of the present invention to provide a linkage which is actuated upon the coupling of the ram and plunger of a machine tool to positively move the plunger in a direction away from a work support only after the tool has engaged the workpiece without being capable in any way of causing such action to occur before the tool engages the workpiece.

Another object of the present invention is to provide an improved construction for moving the tool carrying plunger away from the workpiece without any necessity for providing large clearances between the parts which secure the plunger and the ram together, thereby restricting rapid acceleration of the punch plunger as the punch breaks through a workpiece which in turn causes punching shocks to be absorbed much sooner so that they do not reach the high levels experienced with other constructions.

A further object of the present invention is to provide an improved construction for selectively coupling the plunger and ram of a machine tool, which is relatively simple in construction, which has relatively few parts, which will be less susceptible to malfunction due to the presence of dirt and mill scale, which is generally simpler to fabricate and which is highly reliable in operation.

Yet another object of the present invention is to provide an improved highly simplified single stroke linkage for a machine tool which insures that the machine tool will provide only a single cycle of operation every time it is actuated.

A still further object of the present invention is to provide a combination of a single stroke linkage and a positively acting mechanism for moving a plunger away from a workpiece so as to provide positive reliable movement of the plunger. Other objects and attendant advantages of the present invention will readily be perceived hereafter.

The improved machine tool of the present invention comprises a frame, a plunger mounted on said frame, a ram, means for selectively causing said ram to drive said plunger toward a work support, and bolt means for selectively coupling said ram to said plunger for moving said plunger away from said work support only after said ram has driven said plunger toward said work support. In addition, said means for selectively causing said ram to drive said plunger toward said work support includes single stroke means for effecting only a single movement of said plunger toward said work support when said machine is actuated, said single stroke means including latching means which are positively disengaged at the end of the punching stroke to thereby positively prevent said ram from again driving said plunger until said latching means are reset. The various aspects of the present invention will be more fully understood when the following portions of the specification are read in conjunction with the accompanying drawings wherein:

Figure 1:
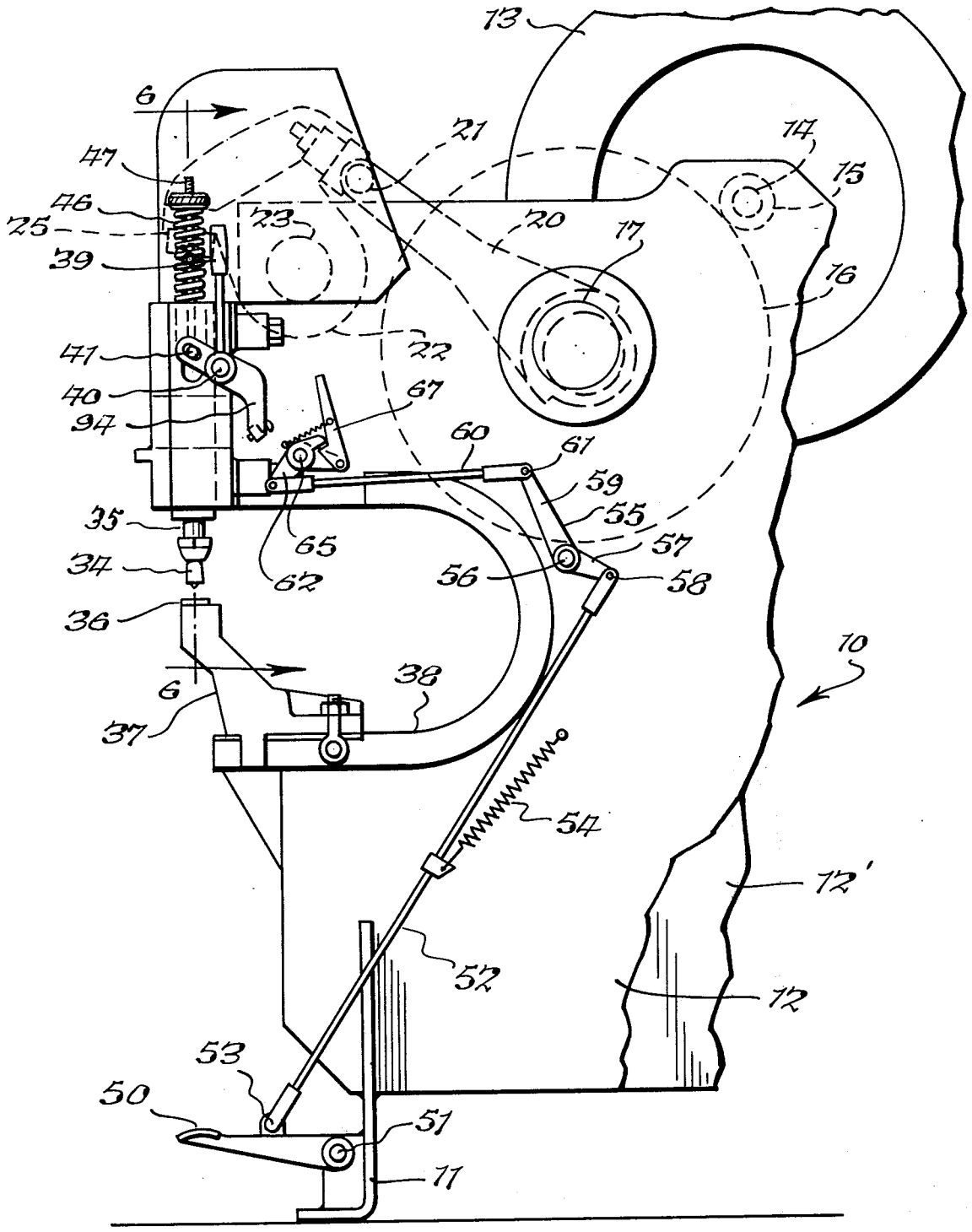
FIG. 1 is a fragmentary side elevational view of the improved punching machine of the present invention.

The improved punching machine 10 of the present invention includes a base 11 which supports a pair of spaced vertical substantially parallel plates 12 and 12′ which define the sides of the machine. A motor, not shown, is suitably mounted on machine 10 and through a suitable drive arrangement, which is preferably a belt, drives flywheel 13 which is keyed to pinion 15. Pinion 15 is journalled to shaft 14 and is in mesh with gear 16 located between sides 12—12′ and keyed to crank shaft 17 supported by sides 12–12′. The crank shaft 17 causes arm 20 to oscillate. The upper end of arm 20 is pivotally connected at 21 to rocker arm 22 which is pivotally supported between plates 12–12′ on shaft 23. A pair of spaced eye bolts 24 (FIG. 6) have their upper ends suitably attached to end 25 of rocker arm 22. The eye portions 26 of eye bolts 24 are mounted on pin 27 which extends through the upper end of ram 28 which is guided for reciprocation in channel or way 29 of punch plunger 30 which in turn is guided for movement within way 31 defined by spaced block-like portions 32 of plunger guide 33 which is fixedly mounted relative to plates 12—12′. Ordinarily ram 28 will reciprocate idly during the operation of the machine without driving plunger 30 which has tool 34, which may be a punch or a knife, secured to the lower end of member 35 which is secured to the underside of plunger 30. However, when it is desired to effect a punching action, suitable linkage, as described hereafter, is actuated to cause ram 28 to drive plunger 30 downwardly to effect the punching operation.

During a punching action a workpiece (not shown) is placed on die 36 (FIG. 1) mounted on die block 37 which is suitably secured on C-shaped frame member 38 which is mounted on plates 12—12′. Thereafter handle 39 (FIGS. 1 and 6), which is journalled to shaft 40, is pivoted in a counterclockwise direction in FIG. 1 so as to cause plunger 30 to move downwardly. This occurs because the reduced end portion 41 of pin 42, which is mounted on side 43 of plunger 30, is located within slot 44 of arm 45 which is fixedly attached to handle 39 and journalled to shaft 40. Therefore, as handle 39 rotates on shaft 40 in a counterclockwise direction, plunger 30 will move downwardly because of the connection between pin 41 and slot 44 in arm 45. This downward movement will occur against the bias of spring 46 which encircles pin 47 having its lower end threadably received in pin 42 and its upper portion threadably carrying adjusting nut 48 which may be used to adjust the compression of spring 46 which is positioned between said tightening nut 48 and the upper surface 49 of plunger guide 33. In the foregoing manner the punch 34 is brought down against the work preparatory to a punching operation.

Figure 3:
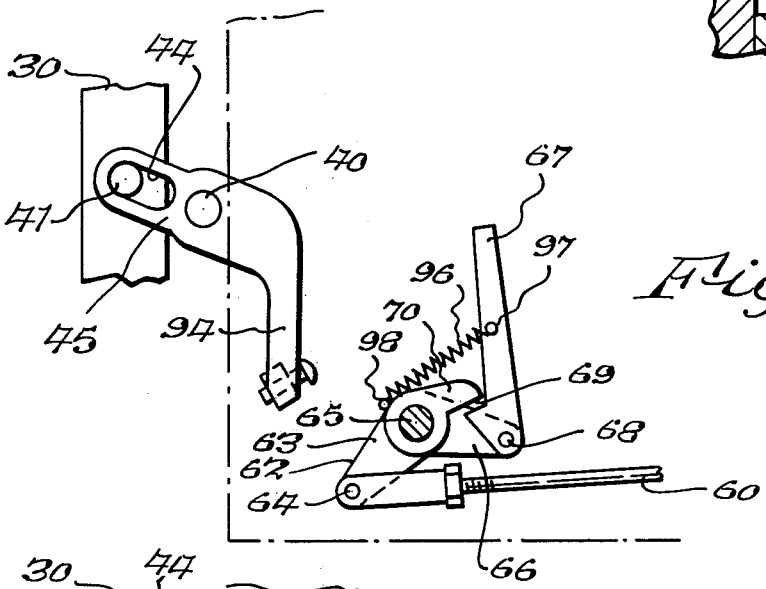
FIG. 3 is an enlarged fragmentary side elevational view of the various parts on the outside of the machine for providing single stroke operation and showing the parts in the position which they occupy before the linkage is actuated in any way.

When it is desired to have the punch 34 act on the workpiece, foot pedal 50 is depressed so that it pivots in a counterclockwise direction about its pivot pin 51. This will cause link 52, which has its lower end pivotally attached to foot pedal 50 at 53, to move downwardly against the bias of spring 54 and in turn cause bellcrank lever 54 to pivot in a clockwise direction about its supporting pin 56, considering that arm 57 of bellcrank lever 55 is pivotally secured to the upper end of link 52 at 58. The other leg 59 of the bellcrank lever is pivotally secured to one end of the link 60 at 61 and the opposite end of link 60 (FIGS. 1, 3 and 4) is pivotally secured to leg 62 of bellcrank lever 63 at 64. Bellcrank lever 62 is journalled for free pivotal motion on shaft 65 which in turn is journalled relative to plates 12—12′. As bellcrank lever 62 pivots in a counterclockwise direction in FIG. 3 due to the movement of link 60 to the right, arm 66 of bellcrank lever 62 will carry latch 67, which is pivotally secured to arm 66 at 68, upwardly until surface 99 thereof engages latch seat 69 formed on collar member 70 which is keyed to shaft 65. Because of this keyed relationship shaft 65 will be caused to pivot in a counterclockwise direction in FIG. 3.

Figure 2:
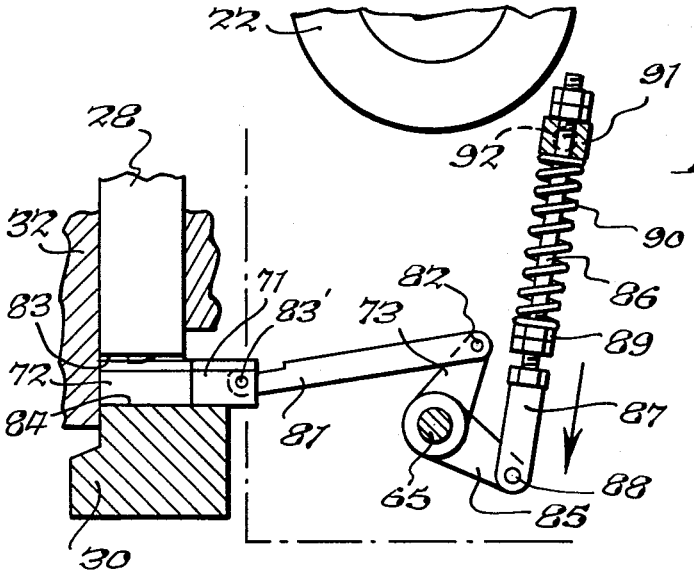
FIG. 2 is a fragmentary cross sectional view of certain of the parts for providing single stroke operation and taken substantially in the direction of line 7—7 of FIG. 6.
Figure 5:
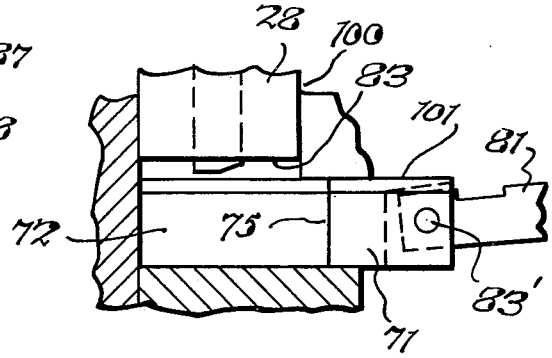
FIG. 5 is a fragmentary cross sectional view taken substantially along line 7—7 of FIG. 6 and showing the relationship between the punch ram and the punch block when the latter is in a retracted, or nonpunching, position.

A linkage is provided to selectively cause ram 28 to drive plunger 30 downwardly. In this respect, when ram 28 is at the top of its stroke, punch block 71 may be inserted within the opening 72 at the lower portion of plunger 30. To this end, a lever 73 is keyed to shaft 65 (FIG. 2). A link 81 has one end pivotally secured to lever 73 at 82 and its opposite end pivotally secured to punch block 71 at 83′. Therefore when lever 73 pivots in a counterclockwise direction, it will cause punch block 71 to enter space 72 between ram 28 and plunger 30. Thereafter, the downward movement of ram 28 will cause a downward movement of plunger 30 because punch block 71 is interposed therebetween and because punch block 71 has a sufficiently great height so that it will transmit the movement of ram 28 to plunger 30.

At this point it is to be noted that when shaft 65 pivots in a counterclockwise direction to drive punch block 71 into space 72, arm 85 which is keyed to shaft 65 will also pivot in a counterclockwise direction about the axis of shaft 65 to move rod 86 upwardly, rod 86 being secured to link 87 which is pivotally mounted on arm 85 at 88. Adjustable nut 89 is threaded on rod 86 and bears against the lower end of spring 90, which encircles rod 86, and the upper end of spring 90 bears against the underside of block 91 which is pivotally mounted on the frame of the machine by pin 92. It will readily be seen therefore that spring 90 is compressed while shaft 65 is pivoting in a counterclockwise direction, and this compression will be used subsequently to drive shaft 65 in a clockwise direction to pull punch block 71 out of opening 72 upon the actuation of other linkages in the system, to thereby insure single stroke punching action even though foot pedal 50 remains depressed.

Figure 4A:
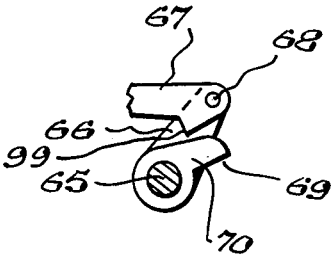
FIG. 4A is a view similar to FIG. 4 but showing the single stroke linkage in the position which it occupies after the single stroke function has been achieved but before the foot pedal is released.
Figure 4:
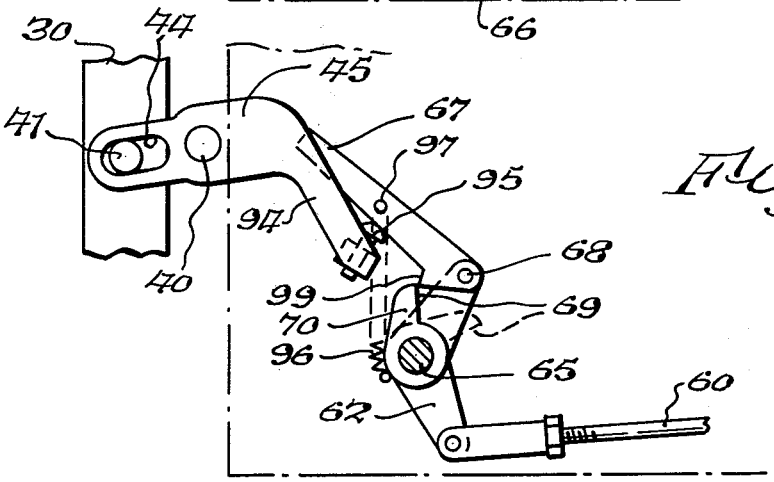
FIG. 4 is a view similar to FIG. 3 and showing the parts for providing single stroke operation in the position which they occupy when the parts are just about to be released so as to prevent an additional stroke.

In order to insure the single stroke punching action, arm 94 of lever 45 (FIG. 4) moves in a counterclockwise direction when plunger 30 moves downwardly because of the connection 41–44 therebetween. Adjustable screw 95 at the end of arm 94 will engage latch 67 and move it upwardly against the bias of spring 96 which is connected between pin 97 on latch 67 and pin 98 on collar 70. As latch 67 rises, shoulder 69, which formerly engaged surface 99 of latch 67, will lose contact therewith because of the pivoting action of latch 67 about its pivot 68. Contact between surfaces 69 and 99 will be terminated when plunger 30 reaches the lowermost position of its stroke and spring 90 (FIG. 2) will be permitted to expand to drive shaft 65 in a clockwise direction thereby moving link 81 to the right to pull punch block 71 out of opening 72. Collar 70 will return to the dotted line position of FIG. 4 (the solid line position of FIG. 4A). The foregoing will occur even though foot pedal 50 remains depressed because the driving engagement between latch 67 and collar 70 has terminated and it will remain terminated until such time as bellcrank lever 62 is driven in a clockwise direction from the position shown in FIG. 4 to the position shown in FIG. 3 by the expansion of spring 54 (FIG. 1) which occurs when the foot pedal 50 is released. FIG. 4A illustrates the relative positions between latch 67 and collar 70 after the single stroke mechanism has withdrawn punch block 71 but before foot pedal 50 has been released.

In accordance with the present invention, there is an unique linkage associated with ram 28 and plunger 30 which prevents premature engagement of the ram with the plunger on the upstroke, thereby obviating what is known as "raising of a spotted punch" which is the premature raising up of the plunger before punching. It will readily be appreciated that this can be quite disconserting to the operator is he is holding the punch in a down position by means of handle 39 and the punch raised up with the accompanying movement of handle 39 in a clockwise direction before the punch again moved downwardly. This could cause the operator to effect undesired movement of the workpiece relative to the die which in turn could result in an improper punching action. Because of the construction of the linkage which eliminates the raising of a spotted punch, additional release mechanisms and other linkages are not required for performing this function. In addition, the linkage which locks the ram 28 to the plunger 30 in the up stroke is such that there is negligible vertical clearance in the linkage which in turn restricts rapid acceleration of the plunger 30 as the punch breaks through the workpiece. In other words, because the ram 28 is locked relatively tightly to the plunger 30, when the punch breaks through the workpiece, the acceleration of plunger 30 will be restricted because it is held back by ram 28 to which it is securely attached, without appreciable clearance. The foregoing causes punching shock to be absorbed much sooner and therefore does not reach the high levels experienced with prior devices.

Figure 6:
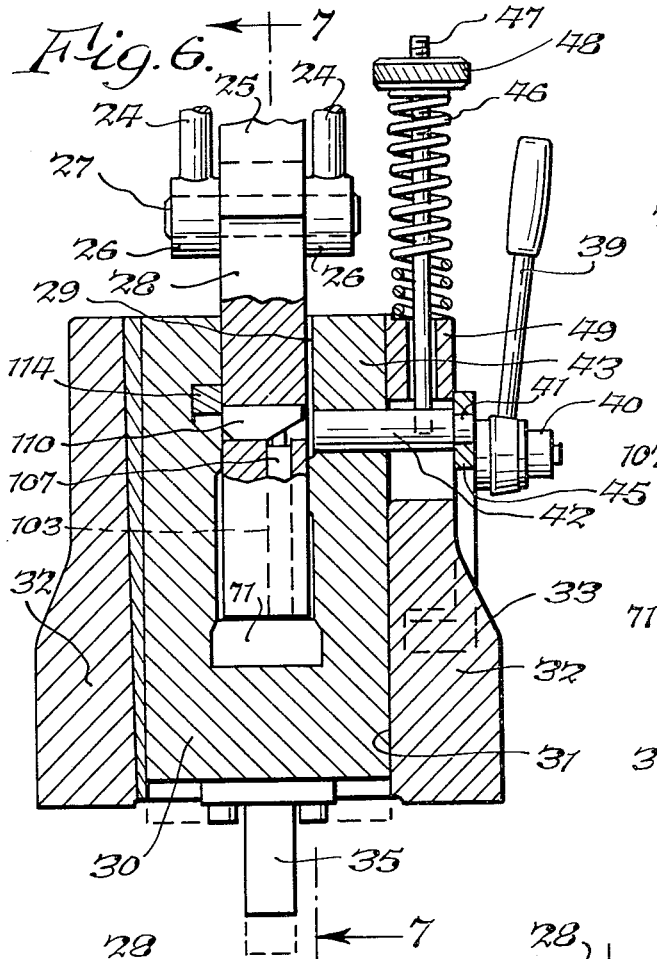
FIG. 6 is a fragmentary cross sectional view taken substantially along line 6—6 of FIG. 1 and showing the relationship between the frame of the machine, the reciprocating punch ram, the punch plunger, and the linkage which is used to selectively lock the two together.
Figure 7:
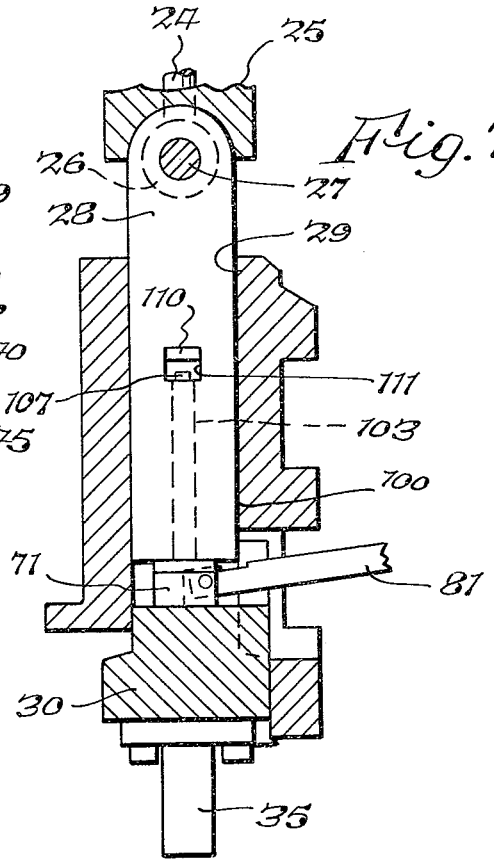
FIG. 7 is a fragmentary cross sectional view taken substantially along line 7—7 of FIG. 6 and showing the punch block in the position which it occupies when the punch ram actuates the punch plunger downwardly.

The improved linkage for achieving the foregoing advantages is shown in FIGS. 6–10. More specifically, as explained above, initially the punch block 71 is in the retracted position shown in FIG. 2 and the ram 28 is reciprocating vertically. At this time the plunger 30 may be in a lowered position as a result of the manipulation of handle 39. The actuation of the foot pedal 50 will advance the punch block 71 from the position shown in FIG. 2 to the position shown in FIG. 7, as explained in detail above. Depending on the position of the punch ram 28, the punch block 71 either goes immediately under the ram or surface 75 thereof or contacts the back surface 100 of the ram until the ram reaches the top of its stroke and thereafter the punch block 71 moves under the ram to the position shown in FIG. 7. When ram 28 descends, the lowermost surface 83 will engage the top 101 of punch block 71. However, before this engagement takes place, end 76 of pusher-pin guide 103, which is a hollow tubular member slidably mounted in bore 104 of ram 28, contacts the top 101 of the punch block to preload a spring (not shown) in housing 105 which biases plunger 106 upwardly, housing 105 being threadably adjustably secured in guide 103. Plunger 106 in turn bears against a pressure pin 107 slidably mounted within pin guide 103. The upper end 108 of the pin 107 is beveled to provide a camming surface and bears against the beveled camming surface 109 of bolt 110 which is slidably mounted in opening 111 of ram 28. The forcible engagement between camming surfaces 108 and 109 will slide bolt 110 to the left in FIG. 8 so that end surface 112 engages side 113 of bolt seat 114 which is rigidly secured to plunger 30. When the bottom 83 of ram 28 engages the top 101 of punch block 71 (FIG. 9) the bolt 110 moves, under the urging of pin 107, from the position shown in FIG. 8 to the position shown in FIG. 9 wherein the end portion thereof enters opening 115 in plunger 30 and beveled camming surface 116 engages beveled camming surface 117 and the top surface 118 of bolt 110 is in abutting relationship with the undersurface 119 of bolt seat 114. Because of the engagement between surfaces 83 and 101 of ram 28 and punch block 101, respectively, the plunger 30 will be forced downwardly with ram 28 until ram 28 reaches the bottom of its stroke. At approximately the bottom of the ram stroke, lever 45 will be in the position shown in FIG. 4 wherein the single stroke mechanism releases the advancing force applied to the punch block through the foot pedal 50, as explained in detail above, and as the ram starts its upward movement, the downward force of the ram on punch block 71 will be relieved and the punch block will be retracted immediately under the bias of spring 90 (FIG. 2). Because of the engagement between bolt 110 and bolt seat 114, (FIG. 9) as the ram 28 begins its upstroke, it will pull the plunger 30 with it because of the contact between surfaces 118 and 119 of bolt 110 and bolt seat 114, respectively. After the punch ram reaches the top of its stroke, plunger 30 will tend to be retained in its uppermost position because of the action of spring 46 (FIG. 6). When ram 28 begins its down stroke, the bolt 110 will be pushed automatically to its retracted position shown in FIG. 10 because of the camming engagement between surfaces 116 and 117 of bolt 110 and chamber 115, respectively. Thereafter ram 28 will continue to reciprocate idly as described above until a new punching cycle is initiated in the manner described above in detail.

Figure 8:
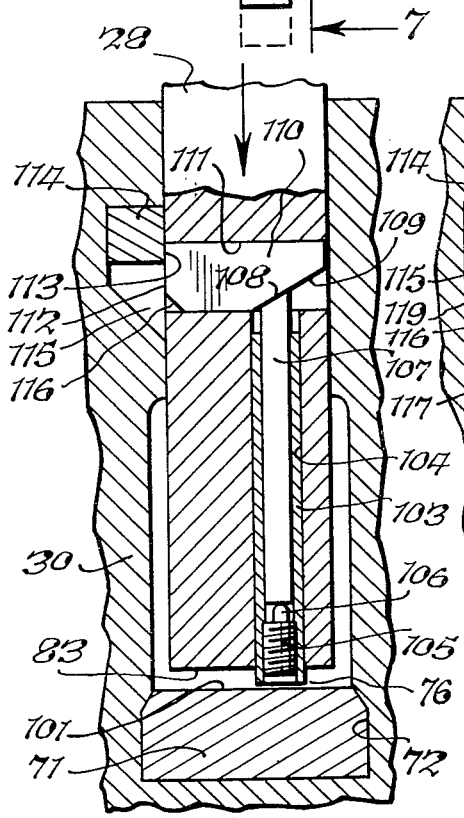
FIG. 8 is an enlarged fragmentary cross sectional view taken substantially along line 7—7 of FIG. 6 and showing the punch bolt in the position in which it occupies before the punch ram engages the punch block.
Figure 9:
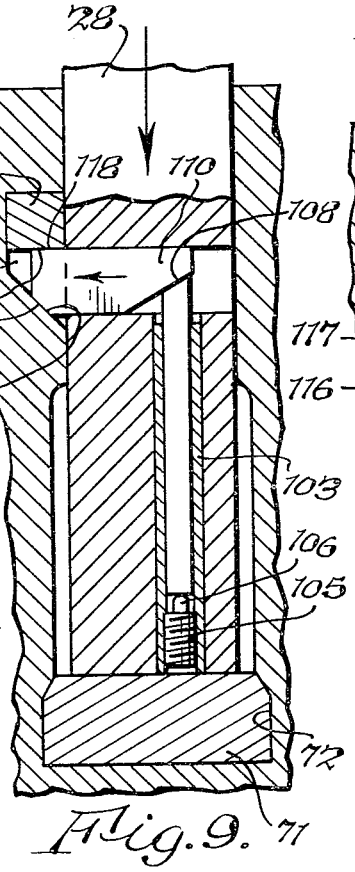
FIG. 9 is a view similar to FIG. 8 and showing the position of the punch bolt after the punch ram engages the punch block.
Figure 10:
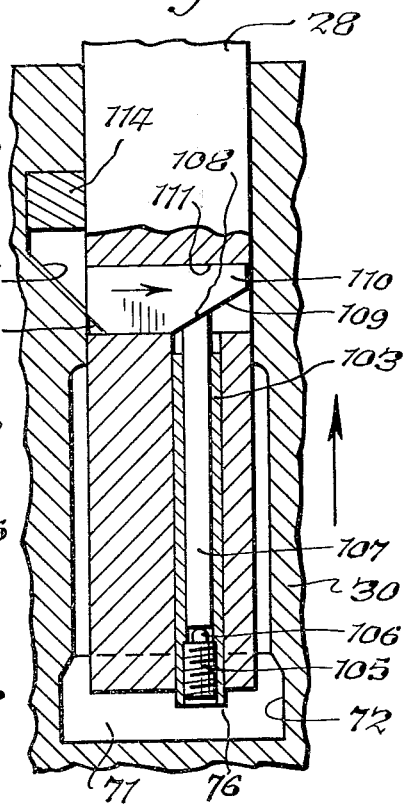
FIG. 10 is a view similar to FIGS. 8 and 9 but showing the retracted position of the punch bolt after the punch block has been automatically withdrawn by the single stroke mechanism.

It will readily be appreciated that the "raising of the spotted punch" characteristic mentioned above which would cause the plunger 30 to be raised prematurely cannot occur with the bolt 110 and its associated structure because the clearances are such that the bolt 110 will not move from the position shown in FIG. 8 to the position shown in FIG. 9 until such time as the plunger 30 is actually moving downwardly under the urging of ram 28. As can be seen from FIG. 9, the clearance between upper surface 118 of bolt 110 and lower surface 119 of bolt seat 114 is negligible and this dimensioning restricts rapid acceleration of the punch plunger as the punch breaks through the workpiece. The resulting punching shock is thus absorbed almost immediately and therefore does not reach the high levels experienced with other types of latching devices.

While the present invention has been described with respect to a punching machine, it will be appreciated that the mechanism is equally applicable to other machine tools which operate in an analogous manner.

It can thus be seen that the improved punching mechanism of the present invention is manifestly capable of achieving the above enumerated objects and while preferred embodiments of the present invention have been disclosed, it will readily be appreciated that the present invention is not limited thereto but may be otherwise embodied within the scope of the following claims.

I claim:

1. A machine tool for punching metal comprising a frame, a work support for holding a metal workpiece, a plunger mounted on said frame, a ram, means for selectively causing said ram to drive said plunger toward said work support, and bolt means rectilinearly slidable relative to both said ram and said plunger for selectively locking said ram to said plunger for moving said plunger away from said work support.

2. A machine tool comprising a frame, a plunger mounted on said frame, a ram, means for selectively causing said ram to drive said plunger toward a work support, bolt means for selectively locking said ram to said plunger for moving said plunger away from said work support, said plunger including a way for receiving said ram, means for effecting reciprocatory movement of said ram in said way, said bolt means comprising a bolt slidably mounted within said ram, bolt receiving means on said plunger for selectively receiving said bolt, and linkage means for selectively moving said bolt into operative relationship with said bolt receiving means.

3. A machine tool as set forth in claim 2 including means for automatically moving said bolt out of operative relationship with said bolt receiving means after said plunger has been moved away from said work support.

4. A machine tool as set forth in claim 2 wherein said means for selectively causing said ram to drive said plunger toward said work support comprises a punch block, a punch block receiving means on said plunger for receiving said punch block so that it may be engaged by said ram, and wherein said linkage means comprises slidable means in said ram actuatable in response to engagement between said ram and said punch block to force said bolt into operative relationship with said bolt receiving means.

5. A machine tool as set forth in claim 4 wherein said slidable means includes a first camming surface, a second camming surface on said bolt in engagement with said first camming surface, and resilient means operatively associated with said slidable means for biasing said first camming surface into engagement with said second camming surface to urge said bolt toward said bolt receiving means.

6. A machine tool as set forth in claim 5 wherein said slidable means includes a bore in said ram, a tubular member slidably mounted in said bore, a pin slidably mounted in said tubular member, and wherein said resilient means comprises spring means secured to said tubular member for biasing said pin toward said bolt.

7. A machine tool as set forth in claim 6 wherein said tubular member includes a portion effectively protruding beyond said ram for engaging said punch block.

8. A machine tool as set forth in claim 5 including means for automatically disengaging said bolt from said plunger.

9. A machine tool as set forth in claim 8 wherein said bolt receiving means includes a seat on said plunger for engagement by said bolt, means on said plunger for tending to maintain it away from said work support, and wherein said means for automatically disengaging said bolt from said plunger comprises a third camming surface on said plunger, a fourth camming surface on said bolt in engagement with said third camming surface when said bolt is in said bolt receiving means, said engagement between said third and fourth camming surfaces while said ram is moving toward said work support and while said plunger is being held away from said work support causing said bolt to move out of said bolt receiving means.

10. A machine tool as set forth in claim 1 wherein said means for selectively causing said ram to drive said plunger toward said work support includes single stroke means for effecting only a single movement of said plunger toward said work support when said machine is actuated.

11. A machine tool as set forth in claim 10, including means for effecting reciprocatory movement of said ram, and wherein said means for selectively causing said ram to drive said plunger toward said work support comprises a punch block, linkage means for moving said punch block between said ram and said plunger to cause said ram to drive said plunger, latch means forming part of said linkage means, spring means for biasing said punch block to a position away from said position between said ram and said plunger, and means driven at a predetermined portion of the stroke of said plunger for disengaging said latch means to permit said spring means to withdraw said punch block from said position between said ram and said plunger.

12. A machine tool as set forth in claim 11 wherein said linkage means includes an actuating portion actuated by a machine operator, and means for resetting said latch means upon the release of said actuating portion by said machine operator.

13. A machine tool as set forth in claim 12 wherein said latch means comprise a shaft on said frame, a lever journalled relative to said shaft, a first latch member keyed to said shaft, a second latch member secured to said lever for selective actuation at said predetermined portion of said stroke of said plunger to thereby be moved out of latching engagement with said first latch member, whereby said spring means can withdraw said punch block while said actuating portion of said linkage means remains actuated by said machine operator.

14. A machine tool as set forth in claim 11 wherein said plunger includes a way for receiving said ram, and wherein said bolt means comprises a bolt slidably mounted in said ram, bolt receiving means on said plunger for selectively receiving said bolt, and second linkage means for selectively moving said bolt into said opening.

15. A machine tool as set forth in claim 14 including means for automatically moving said bolt out of operative relationship with said bolt receiving means after said plunger has been moved away from said work support.

16. A machine tool as set forth in claim 15 wherein said second linkage means comprises slidable means in said ram actuatable in response to engagement between said ram and said punch block to force said bolt into operative relationship with said bolt receiving means.

17. A machine tool as set forth in claim 16 wherein said slidable means includes a first camming surface, a second camming surface on said bolt in engagement with said first camming surface, and resilient means operatively associated with said slidable means for biasing said first camming surface into engagement with said second camming surface to urge said bolt toward said bolt receiving means.

18. A machine tool as set forth in claim 17 wherein said slidable means includes a bore in said ram, a tubular member slidably mounted in said bore, a pin slidably mounted in said tubular member, and wherein said resilient means comprises spring means secured to said tubular member for biasing said pin toward said bolt.

19. A machine tool as set forth in claim 17 including means for automatically disengaging said bolt from said plunger.

20. A machine tool comprising a frame, a plunger mounted on said frame, means on said plunger for mounting a tool for acting on a workpiece, a ram, means for selectively causing said ram to drive said plunger toward a work support, and locking means for selectively locking said ram to said plunger for moving said plunger away from said work support including means for preventing said plunger from being moved away from said work support by said ram until after said plunger has been moved toward said work support by said ram, whereby premature movement of said plunger away from said workpiece cannot be effected.

21. A machine tool comprising a frame, a plunger mounted on said frame, a ram, means for selectively causing said ram to drive said plunger toward a work support, bolt means for selectively locking said ram to said plunger for moving said plunger away from said work support, means on said plunger for mounting a tool for acting on a workpiece, and means for preventing said plunger from being moved away from said work support by said ram until after said plunger has been moved toward said work support by said ram, whereby premature movement of said plunger away from said workpiece cannot be effected.

* * * * *